US008376916B2

(12) United States Patent
Tsakiris

(10) Patent No.: US 8,376,916 B2
(45) Date of Patent: Feb. 19, 2013

(54) HEAVY BAG WITH SEMI-RIGID PERIPHERAL EXTERIOR FOR MARTIAL ARTS TRAINING

(76) Inventor: Peter Tsakiris, Ocean Township, NJ (US)

( * ) Notice: Subject to any disclaimer, the term of this patent is extended or adjusted under 35 U.S.C. 154(b) by 460 days.

(21) Appl. No.: 12/661,889

(22) Filed: Mar. 26, 2010

(65) Prior Publication Data

US 2010/0261584 A1 Oct. 14, 2010

Related U.S. Application Data

(60) Provisional application No. 61/212,142, filed on Apr. 9, 2009.

(51) Int. Cl.
*A63B 69/34* (2006.01)

(52) U.S. Cl. ..... 482/83; 482/86

(58) Field of Classification Search ..... 482/83–90, 482/105; 473/438, 441–445
See application file for complete search history.

(56) References Cited

U.S. PATENT DOCUMENTS

| | | | | | |
|---|---|---|---|---|---|
| 3,337,217 | A * | 8/1967 | Cummins | 473/442 |
| 5,261,821 | A * | 11/1993 | Shic | 434/247 |
| 5,700,229 | A * | 12/1997 | Karnofsky | 482/83 |
| 6,234,940 | B1 * | 5/2001 | Fotsis | 482/83 |
| 6,261,210 | B1 * | 7/2001 | Lishejkov et al. | 482/83 |
| 6,558,298 | B2 * | 5/2003 | Fields et al. | 482/87 |
| 7,063,648 | B1 * | 6/2006 | Brigham | 482/83 |
| 7,867,148 | B2 * | 1/2011 | Tsakiris | 482/83 |
| 2008/0096733 | A1 * | 4/2008 | Epstein | 482/83 |
| 2011/0077134 | A1 * | 3/2011 | Smith | 482/83 |
| 2011/0111928 | A1 * | 5/2011 | Tsakiris | 482/87 |
| 2011/0237404 | A1 * | 9/2011 | Smith | 482/83 |

* cited by examiner

*Primary Examiner* — Loan Thanh
*Assistant Examiner* — Victor K Hwang
(74) *Attorney, Agent, or Firm* — Clifford G. Frayne

(57) ABSTRACT

A heavy bag for use by martial arts practitioners to practice the martial arts, the heavy bag adapted to receive a sheath about its circumferential periphery, the sheath having a plurality of vertically longitudinal sleeves or pockets for the slidable receipt of semi-rigid tubes, rods, or pellets which would therefore be disposed about the circumference of the heavy bag and when struck by a martial arts practitioner with a select anatomical body part would toughen and desensitize the particular anatomical body part. In the preferred embodiment, the sheathing would be in two parts, a lower sheathing secured about the lower portion of the heavy bag by means of hook and loop fastener means, and an upper sheathing which would depend from the four point linkage used for hanging the heavy bag, the lower portion of the upper sheathing being secured by hook and loop fasteners about the circumference of the heavy bag. Alternatively, the sheath may be permanently attached to the heavy bag and sold and used as only a body conditioner bag.

27 Claims, 2 Drawing Sheets

HEAVY BAG WITH SEMI-RIGID PERIPHERAL EXTERIOR FOR MARTIAL ARTS TRAINING

RELATED APPLICATIONS

Applicant claims the benefit of provisional application Ser. No. 61/212,142, filed Apr. 9, 2009.

BACKGROUND OF THE INVENTION

1. Field of the Invention

The present invention relates to exercise equipment, and more particularly, to heavy bags typically used in boxing and martial arts and athletic training, and to a peripheral exterior for the heavy bag comprising semi-rigid tubes or rods or pellets positioned within sleeves disposed about the heavy bag for striking with the arms and legs in order to toughen and desensitize the arms and legs.

2. Description of the Prior Art

Heavy bags are generally vertical, longitudinal cylinders which are supported by a frame or from a ceiling. The bags are formed from a canvass, leather, or other suitable shell material which normally is wear resistant so as to stand up to punches, kicks and other athletic movement, as well as strikes from inanimate objects. The heavy bags are filled with a stuffing material which can vary to include cloth in the form of rags, a foam filler material, or sand filler material, or any other energy absorbent material which can provide resistance, yet some flexibility to the punches, kicks and other athletic movement.

The heavy bag is most often associated with boxers, however, martial arts practitioners utilize the heavy bag to strike with different parts of the anatomy. While a boxer would primarily use the heavy bag for hand or fist strikes, the martial arts practitioner would strike the heavy bag with the hands, fist, forearms, elbow, knee, shin, and feet, since all of these anatomical areas are used for offense and defense in the martial arts.

In many instances, martial arts practitioners seek to toughen and desensitize the aforementioned anatomical areas so that in an actual martial arts competition, these particular anatomical areas are less subject to pain by the individual when striking or defending.

In the Far East where the marital arts originated, martial arts practitioners accomplished this toughening and desensitization by striking at shafts of bamboo or other flexible plant material. This material is not always available in a gym or dojo, and therefore there has been a need for an apparatus which can be used in a gym in cooperation with a heavy bag which allows the conversion of the heavy bag from its typical use and function to a target which can be used for toughening and desensitizing anatomical parts of the body for martial arts practitioners.

Applicant's device provides for a heavy bag which easily incorporates a sheathing which converts the heavy bag from its normal configuration to one with an exterior sheathing of sleeves or pockets for receipt of tubing, rods or pellets about the periphery which can be struck by the martial arts practitioners with an anatomical body part of their choosing in order to tough and desensitize that body part. The sheathing is easily installed and removed from the heavy bag so that the heavy bag can now perform more than one function. Still further Applicant's sheathing apparatus can also be adapted to heavy bags which are already in use in commerce.

OBJECTS OF THE INVENTION

An object of the present invention is to provide a novel heavy bag for athletic and martial arts training which incorporates a removable sheath of semi-rigid tubes, rods, or pellets, the sheath designed to be struck by an anatomical body part in order to toughen and desensitize the particular anatomical body part.

Another object of the present invention is to provide for a novel heavy bag which is designed to readily accept a peripheral sheathing, which includes a plurality of semi-rigid tubing, rods, or pellets longitudinally vertically spaced apart about the heavy bag for striking with an anatomical body part.

A still further object of the present invention is to provide for a novel peripheral sheathing of vertical sleeves which accepts vertically oriented semi-rigid tubes, rods, or a plurality of bean sized pellets which can be easily peripherally disposed about the circumference of an existing heavy bag and convert the heavy bag to a training apparatus for martial arts practitioners in order to toughen and desensitize anatomical body parts used in striking and defending in the martial arts.

A still further object of the present invention is to provide for a novel peripheral sheathing which incorporates a surface area and configuration or pattern that is of sufficient hardness, density, and texture to enable desensitizing and/or toughening of selected body parts through repeated strikes to sheath surface.

SUMMARY OF THE INVENTION

A heavy bag for use by martial arts practitioners to practice the martial arts, the heavy bag adapted to receive a sheath about its circumferential periphery, the sheath having a plurality of vertically longitudinal sleeves or pockets for the slidable receipt of semi-rigid tubes, rods, or pellets which would therefore be disposed about the circumference of the heavy bag and when struck by a martial arts practitioner with a select anatomical body part would toughen and desensitize the particular anatomical body part. In the preferred embodiment, the sheathing would be in two parts, a lower sheathing secured about the lower portion of the heavy bag by means of hook and loop fastener means, and an upper sheathing which would depend from the four point linkage used for hanging the heavy bag, the lower portion of the upper sheathing being secured by hook and loop fasteners about the circumference of the heavy bag. Alternatively, the sheath may be permanently attached to the heavy bag and sold and used as only a body conditioner bag.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
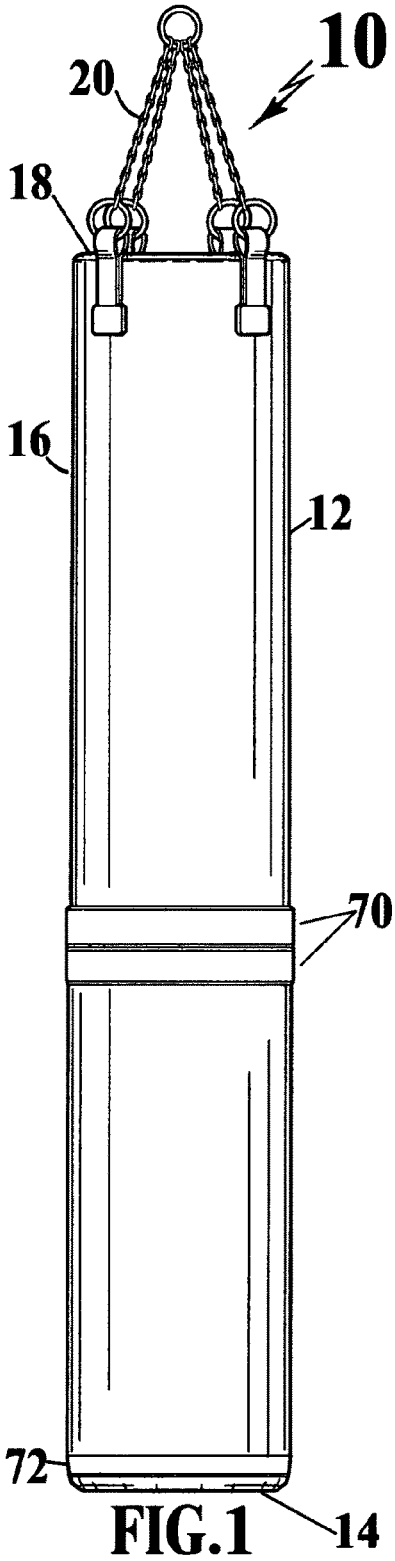
FIG. 1 is a side view of a heavy bag which has been modified with a hook and loop fastener means.
Figure 2:
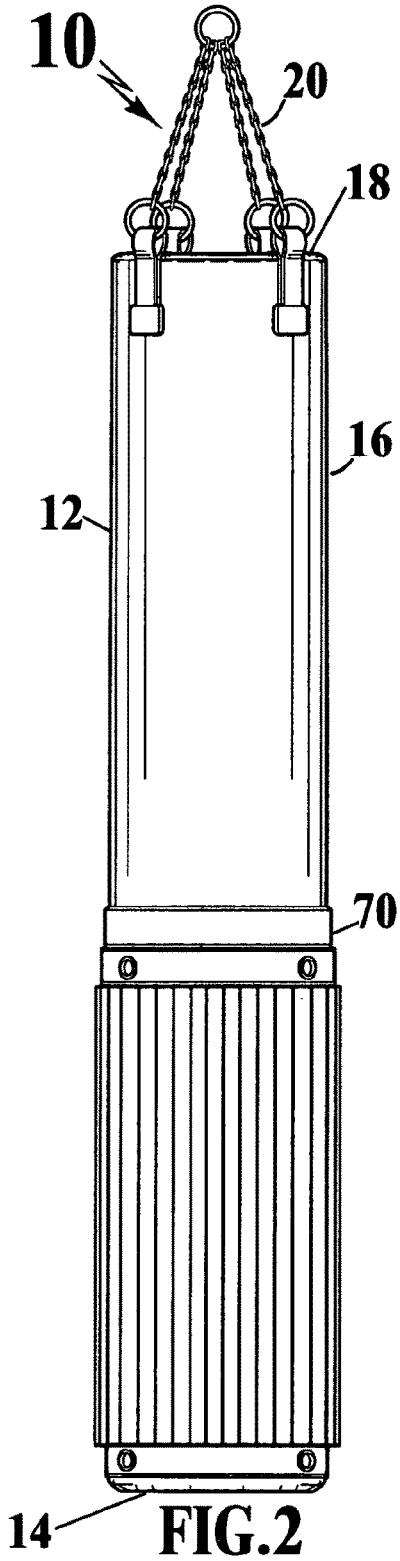
FIG. 2 is a side view of the heavy bag of FIG. 1 with the lower sheath in place.
Figure 3:
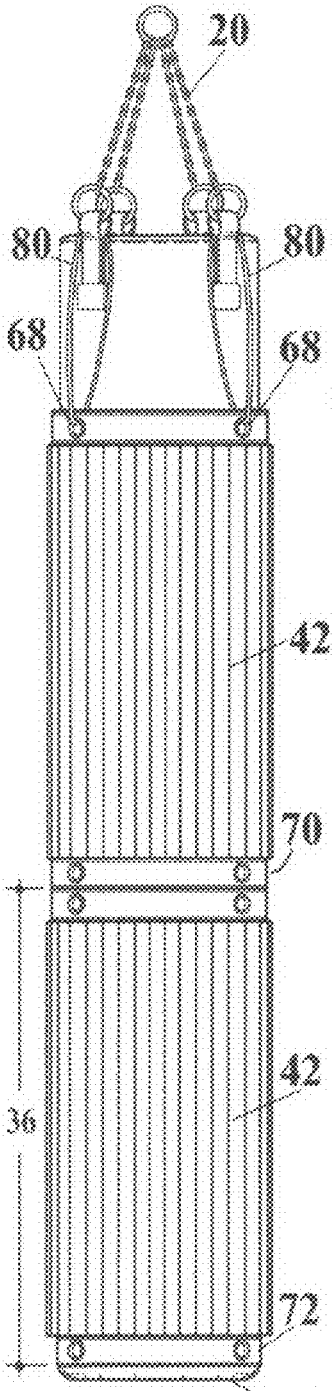
FIG. 3 is a side view of the heavy bag of FIG. 1 with both the lower and upper sheath in position.

FIG. 1 is a typical view of a heavy bag 10. Heavy bag 10 consists of a shell 12 fabricated from leather, canvass, or other suitable durable material which will withstand the repeated blows of a boxer or a martial arts practitioner. The heavy bag is stuffed with an energy absorbing material (not shown) which could be cloth, foam filler, sand filler, or any other suitable energy absorbing material. When stuffed, the heavy bag 10 takes the form of a cylinder having a closed bottom 14, cylindrical peripheral side wall 16 and top 18 which is formed with a suitable closure (not shown) to allow for the stuffing of the bag. Typically, a heavy bag 10 is hung by a four point linkage system 20 as illustrated in FIGS. 1, 2, and 3. However, it will be recognized by those of ordinary skill in the art that other means of support other than the four point linkage system may be used. Further, the heavy bag 10 may vary in length. A boxer who utilized the heavy bag 10 for striking with the fists and hands would require a heavy bag 10 the bulk of which would be at waist or at least head height. A martial arts practitioner who would strike the heavy bag with not only his hands and arms, but also with his knees, shins, elbows, and feet, would require a heavy bag 10 of greater length. The semi-rigid peripheral exterior sheathing as disclosed hereafter by Applicant, could be adapted to bags of varying lengths.

Figure 5:
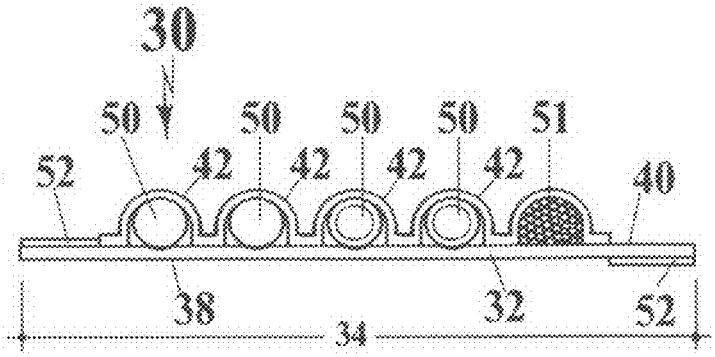
FIG. 5 is a top view of a portion of the sheath of the present invention.
Figure 4:
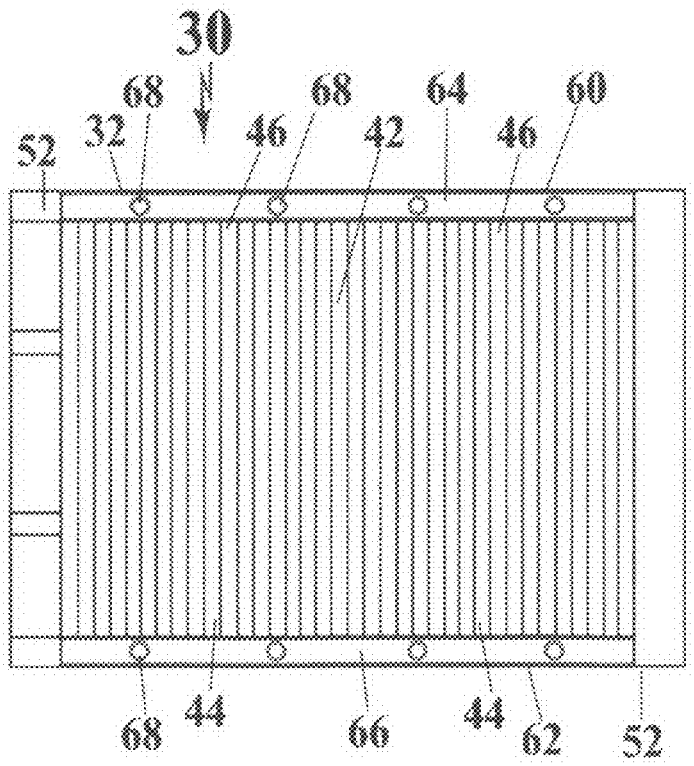
FIG. 4 is a planar view of a sheath of the present invention.

Referring to FIGS. 4 and 5, there is a plan view, FIG. 4, and a top view, FIG. 5 of a peripheral exterior sheath 30 which can be removably affixed to heavy bag 10. Peripheral sheath 30 is comprised of a flexible base member 32 having a length 34 sufficient to allow it to be wrapped about the peripheral circumference of a heavy bag 10 and a height 36, sufficient to enwrap approximately half of the height of a heavy bag 10.

The base material can be made of cloth, leather polymer, or any other suitable, flexible material which has a degree of durability to stand up to being struck repeatedly by anatomical parts of the body. The first side 38 of the base member 30 is planar and juxtaposes the outer circumference of the heavy bag 10. The opposing side 40 of the base material 30 is formed with a plurality of longitudinal sleeves or pockets 42 which are juxtaposed to each other on the opposing side 40 of base member and which are semi-circular in cross-sectional area. Longitudinal sleeves or pockets 42 would have a closed bottom end 44 and could remain open at their upper end 46 or have a removable closure means. Longitudinal sleeves or pockets 42 are designed for receipt of a semi-rigid rod or tube 50 or bead-like pellets 51 within each longitudinal sleeve or pocket 42. The rods, tubes or pellets increase the resistance offered to the martial artist and enhance and augment the desensitizing process. They also provide acoustical feedback to the martial artist regarding the strength and effectiveness of his strikes with various body parts. In that regard the bead-like pellets, because of their quantity and packing in the sleeves, provide the preferable acoustic feedback.

The base member 32 would be formed with complimentary hook and loop fasteners 52 at one end of first side 38 and at the opposing end of opposing side 40 which would allow these hook and loop fasteners to overlap and engage when the base member 32 is wrapped about the heavy bag 10. The closure overlap allows for bags of various circumferences. The longitudinal edges 60 and 62 of first side 38 of the base member 32 are also formed with hook and loop fasteners 64 and 66 which would cooperate with a belt of hook and loop fasteners 70 and 72 disposed about the circumference of heavy bag 10 as illustrated in FIGS. 1 and 2.

The base member 32 and longitudinal sleeves or pockets 42 with their semi-rigid tubes or rods 50 or pellets 51 disposed therein, would be secured about the heavy bag 10 in two zones. A first lower zone would be secured as illustrated in FIG. 2 by the interactive cooperation of the hook and loop 64 and 66 fasteners with belts 70 and 72 about heavy bag 10 thus encircling the lower portion of heavy bag 10. This lower sheath 30 could be used independently if the martial arts practitioner merely wished to work on toughening and desensitizing the lower extremities. However if the martial arts practitioner wished to toughen and desensitize the upper extremities, a second upper sheath 30 would be secured about heavy bag 10 by means of the eyelets 68 in cooperation with the support cord 80 which would depend the upper sheathing 30 from the four point linkage 20 which supports heavy bag 10. The bottom edge of the upper sheathing 30 would have a complimentary hook and loop fastener strip 66 located on first side 38 so as to engage the upper belt 70 of the hook and loop strip which encircles the heavy bag. In this configuration, the martial arts practitioner can toughen and desensitize both the upper and lower extremities. The upper and lower sheath elements are identical so that they may be used as either the upper or lower sheath, being supported solely by hook and loop fasteners (lower sheath) or support cords and hook and loop fasteners (upper sheath).

It will be recognized by those skilled in the art, that both the upper and lower sheathing can be easily and facilely disposed onto the heavy bag for the martial arts practitioner and both the upper and lower sheathing can be quickly and easily removed when not required, returning the heavy bag to its normal configuration.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A heavy bag for martial arts training for toughening and desensitizing the anatomical limb striking points on the body of a martial artist, said heavy bag comprising:

an outer cylindrical shell defining a cylindrical cavity, said cavity having resilient stuffing positioned therein to acquire a desired density of said heavy bag, a linkage system secured to an upper end of said heavy bag to hang said heavy bag in a vertical position;

a sheathing disposed about said outer cylindrical shell, said sheathing comprised of a plurality of vertical longitudinal pockets juxtaposed each other;

a plurality of resilient, semi-rigid inserts receivable within each of said plurality of vertical pockets thereby forming an outer surface of said heavy bag comprised of a plurality of vertical longitudinal crests and troughs; and a means for securing said sheathing about said outer cylindrical shell.

2. The heavy bag for martial arts training in accordance with claim 1 wherein said sheathing is a one piece construction for circumferential juxtaposition about said outer cylindrical shell, said plurality of vertical longitudinal pockets extending the length of said sheathing, said plurality of vertical longitudinal pockets being securably closed at an upper end and fixedly closed at a lower end, said sheathing being secured at an upper and a lower end of said outer cylindrical shell.

3. The heavy bag for martial arts training in accordance with claim 2 wherein said sheathing is secured permanently about said outer cylindrical shell.

4. The heavy bag for martial arts training in accordance with claim 2 wherein said sheathing is removably secured about said outer cylindrical shell by means of an upper and lower draw string.

5. The heavy bag for martial arts training in accordance with claim 1 wherein said sheathing is of two piece construction, a first sheathing being disposed about an upper half of said outer cylindrical shell and a second sheathing disposed about a lower half of said outer cylindrical shell, said first sheathing and said second sheathing having said plurality of vertical longitudinal pockets with open tops and closed bottoms.

6. The heavy bag for martial arts training in accordance with claim 5 wherein said two piece sheathing is removably secured about said outer cylindrical shell by means of hook and loop fasteners.

7. The heavy bag for martial arts training in accordance with claim 1 wherein said resilient, semi-rigid inserts comprise longitudinal solid rods having a geometric cross section.

8. The heavy bag for martial arts training in accordance with claim 1 wherein said resilient, semi-rigid inserts comprise longitudinal hollow tubular rods of a geometric cross section.

9. The heavy bag for martial arts training in accordance with claim 1 wherein said resilient, semi-rigid inserts comprise a plurality of coffee bean sized pellets positioned within said plurality of vertical longitudinal pockets.

10. A training aid for martial arts training for toughening and desensitizing the anatomical limb striking points of the body of a martial artist, the training aid comprising:

a heavy bag having an outer cylindrical shell defining a cylindrical cavity, said cavity having resilient stuffing positioned therein to acquire a desired density of said heavy bag, a linkage system secured to an upper end of said heavy bag to hang said heavy bag in a vertical position;

a sheathing disposed about said outer cylindrical shell of said heavy bag, said sheathing comprised of a plurality of vertical longitudinal pockets juxtaposed each other;

a plurality of resilient, semi-rigid inserts slidably receivable within each of said plurality of vertical pockets thereby forming an outer surface of said heavy bag comprised of a plurality of vertical longitudinal crests and troughs; and a means for securing said sheathing about said heavy bag.

11. The training aid for martial arts training in accordance with claim 10 wherein said sheathing is a one piece construction for circumferential juxtaposition about said outer cylindrical shell of said heavy bag, said plurality of vertical longitudinal pockets extending the length of said sheathing, said plurality of vertical longitudinal pockets being securably closed at an upper end and fixedly closed at a lower end, said sheathing being secured at the upper end and a lower end of said heavy bag.

12. The training aid for martial arts training in accordance with claim 11 wherein said sheathing is secured permanently about said heavy bag.

13. The training aid for martial arts training in accordance with claim 11 wherein said sheathing is removably secured about said heavy bag by means of an upper and lower draw string.

14. The training aid for martial arts training in accordance with claim 10 wherein said sheathing is of two piece construction, a first sheathing being disposed about an upper half of said heavy bag and a second sheathing disposed about a lower half of said heavy bag, said first sheathing and said second sheathing having said plurality of vertical longitudinal pockets with securably closed upper ends and fixedly closed lower ends.

15. The training aid for martial arts training in accordance with claim 14 wherein said two piece sheathing is removably secured about said heavy bag by means of hook and loop fasteners.

16. The training aid for martial arts training in accordance with claim 10 wherein said resilient, semi-rigid inserts comprise longitudinal solid rods having a geometric cross section.

17. The training aid for martial arts training in accordance with claim 10 wherein said resilient, semi-rigid inserts comprise longitudinal hollow tubular rods of a geometric cross section.

18. The training aid for martial arts training in accordance with claim 10 wherein said resilient, semi-rigid inserts comprise a plurality of coffee bean sized pellets positioned within said plurality of vertical longitudinal pockets.

19. A supplemental cover for a heavy bag for martial arts training, wherein the heavy bag is comprised of an outer cylindrical shell defining a cylindrical cavity for the receipt of resilient stuffing material to a desired density, the heavy bag having a support linkage for permitting the heavy bag to be hung in a vertical position presenting a cylindrical target to a martial artist, said supplemental cover comprising a sheathing for toughening and desensitizing the striking points on the body of the martial artist, said sheathing comprising:

a flexibly resilient, durable shell material disposed about the cylindrical shell of the heavy bag, said sheathing material having a plurality of vertical longitudinal pockets formed therein, said plurality of vertical pockets for receipt of a plurality of resilient semi-rigid inserts slidably positioned within said vertical longitudinal pockets for to form an outer surface about the heavy bag presenting a surface of alternate crests and troughs; and a securing means for securing said supplemental cover about the heavy bag.

20. The supplemental cover for a heavy bag for martial arts training in accordance with claim 19 wherein said sheathing is a one piece construction for circumferential juxtaposition about the outer cylindrical shell of the heavy bag, said plurality of vertical longitudinal pockets extending the length of said sheathing, said plurality of vertical longitudinal pockets being securably closed at an upper end and fixedly closed at a lower end, said sheathing being securable to an upper and a lower end of the heavy bag.

21. The supplemental cover for a heavy bag for martial arts training in accordance with claim 20 wherein said sheathing is secured permanently about the heavy bag.

22. The supplemental cover for a heavy bag for martial arts training in accordance with claim 20 wherein said sheathing is removably secured about the heavy bag by means of an upper and lower draw string.

23. The supplemental cover for a heavy bag for martial arts training in accordance with claim 19 wherein said sheathing is of two piece construction, a first sheathing being disposed about an upper half of the heavy bag and a second sheathing disposed about a lower half of the heavy bag, said first sheathing and said second sheathing having said plurality of vertical longitudinal pockets with securably closed upper ends and fixedly closed lower ends.

24. The supplemental cover for a heavy bag for martial arts training in accordance with claim 23 wherein said two piece sheathing is removably secured about the heavy bag by means of hook and loop fasteners.

25. The supplemental cover for a heavy bag for martial arts training in accordance with claim 19 wherein said resilient, semi-rigid inserts comprise longitudinal solid rods having a geometric cross section.

26. The supplemental cover for a heavy bag for martial arts training in accordance with claim 19 wherein said resilient, semi-rigid inserts comprise longitudinal hollow tubular rods of a geometric cross section.

27. The heavy bag for martial arts training in accordance with claim 19 wherein said resilient, semi-rigid inserts comprise a plurality of coffee bean sized pellets positioned within said plurality of vertical longitudinal pockets.

* * * * *